US005867873A

United States Patent [19]

Arend

[11] Patent Number: 5,867,873

[45] Date of Patent: Feb. 9, 1999

[54] FABRIC SECURING DEVICE

[76] Inventor: Karsten A. R. Arend, 1 Bridle Heath Gate, Don Mills, Ontario M3B 2B3, Canada

[21] Appl. No.: 806,306

[22] Filed: Feb. 26, 1997

[51] Int. Cl.[6] ..... A44B 21/00

[52] U.S. Cl. ..... 24/300; 24/326; 5/498; 297/228; 297/218.5

[58] Field of Search ..... 24/326, 335, 298, 24/300–302, 336, 339, 341; 297/228, 218.5; 5/498, 494

[56] References Cited

U.S. PATENT DOCUMENTS

| | | | |
|---|---|---|---|
| 103,753 | 5/1870 | Knight | 24/327 X |
| 806,521 | 12/1905 | Childs . | |
| 1,277,483 | 9/1918 | Rogers | 24/300 X |
| 1,365,169 | 1/1921 | Goldberg . | |
| 1,858,787 | 5/1932 | Ottenheimer . | |
| 2,727,565 | 12/1955 | Moser . | |
| 2,931,084 | 4/1960 | De Witt | 24/302 X |
| 3,976,234 | 8/1976 | Moudry et al. | 24/302 X |
| 3,977,047 | 8/1976 | Lege | 24/302 |
| 4,541,137 | 9/1985 | Murray . | |
| 4,844,540 | 7/1989 | Pegram . | |
| 4,858,285 | 8/1989 | Dala et al. . | |
| 4,937,904 | 7/1990 | Ross . | |
| 5,441,789 | 8/1995 | Walker . | |
| 5,651,633 | 7/1997 | Howe | 24/300 X |

FOREIGN PATENT DOCUMENTS

| | | | |
|---|---|---|---|
| 23816 | 1/1908 | Sweden | 24/302 |

*Primary Examiner*—James R. Brittain
*Attorney, Agent, or Firm*—Barrigar & Moss

[57] ABSTRACT

A fabric securing device for securing a fabric article. The fabric securing device comprises a fabric clamp for releasably engaging a fabric article, a flexible band, and clips for releasably connecting the flexible band to the fabric clamp. One or more of the fabric securing devices can be used to secure a fabric article such as a beach towel to a structure such as a beach chair. One or more of the fabric securing devices can be used in combination with anchoring stakes to secure a fabric article such as a beach towel to a surface such as a sandy beach.

18 Claims, 8 Drawing Sheets

FABRIC SECURING DEVICE

BACKGROUND OF THE INVENTION

The present invention relates to devices for securing fabric articles such as beach towels.

Beach towels are often used by persons at beaches, near pools, on cruises, and in other situations. Often, people place beach towels on beach chairs, on sand beaches, and on other surfaces so that they may sit or lie on the beach towels. Frequently, beach towels placed on such surfaces will shift and move when the person sitting or lying on the towel shifts his or her weight or otherwise moves, which may place the towel in an uncomfortable position or push it out from under the person. If the towel is placed on a chair, it may fall partially or completely off the chair. Additionally, a breeze or wind can cause a towel to shift, or even blow away, especially if the towel is left unattended.

Various devices have been proposed for securing beach towels to beach chairs, however the existing devices have various disadvantages. For example, U.S. Pat. No. 4,858,285 issued Aug. 22, 1989, to M. L. Dala et al. discloses a towel clip for holding a towel in place on the back of a beach chair. However, the towel clip lacks versatility in that it is primarily intended for use with beach chairs with tubular frames. U.S. Pat. No. 4,844,540 issued Jul. 4, 1989, to R. C. Pegram discloses a beach towel having a number of elastic straps for attaching the towel to a beach chair. This device also lacks versatility as the elastic straps are permanently fixed in one position to one towel. U.S. Pat. No. 5,441,789 issued Aug. 15, 1995 to G. Walker discloses a beach towel which has a number of velcro straps attached to it. Again, this device lacks versatility as the straps are permanently fastened directly to the towel.

Fabric articles other than beach towels are also subject to unwanted movement resulting from shifting people or blowing wind. For example, sheets often shift on beds and unsecured table cloths are frequently blown off of outdoor tables. Various devices have been proposed for securing such articles. For example, U.S. Pat. No. 806,521 issued Dec. 5, 1905, to J. Childs discloses a bed clothes fastener which is comprised of a fabric engaging clamp, a resilient band, and a cord. However, this fastener is inconvenient as the cord must be tied and untied to secure the fastener to the bed frame.

Thus, it is desirable to provide a fabric securing device that allows a wide variety of fabric articles to be easily and quickly secured to furniture or other structures in order to minimize unwanted movement and shifting of the fabric articles. It is also desirable to provide a fabric securing device that can be used in combination with portable anchoring devices for securing a fabric article on beaches and other surfaces.

BRIEF SUMMARY OF THE INVENTION

According to one aspect of the invention, a fabric securing device for securing a fabric article is provided. The fabric securing device comprises a fabric clamp for releasably engaging a fabric article, a flexible band, a first clip member for releasably connecting a first portion of the band to the fabric clamp, and a second clip member for releasably connecting a second portion of the band to the fabric clamp. Preferably, two apertures are formed through the fabric clamp and each of the clip members include a hook portion that can be inserted into one of the apertures for releasably connecting the respective clip member to the fabric clamp.

In another preferred embodiment, the fabric clamp of the fabric securing device comprises a main clamp body and a clamping member for releasably securing a fabric article to the main body, and the main clamp body is generally planar with the two aperatures being located in the main clamp body.

In a further preferred embodiment, the main clamp body has an elongate hole formed therethrough, the hole having a first hole portion communicating with a second hole portion, the width of the first hole portion being larger than the width of the second hole portion, and the clamping member comprises a stud with an enlarged head, the dimension of the enlarged head and the stud being such that the clamping member can be secured to the main clamp body by inserting the stud into the first hole portion and moving the stud from the first hole portion to said second hole portion.

In a further preferred embodiment, the fabric securing device includes an anchor for securing a portion of said flexible band to a surface. The anchor may comprise a stake having a central shaft and two planar wings extending in substantially opposite directions from the central shaft.

According to a further aspect of the invention, a fabric securing device for securing a fabric article is provided, the fabric securing device comprising a fabric clamp for releasably engaging a fabric article, a flexible band member having a first end and a second end, the second end being connected to the fabric clamp, and a clip member attached to the first end of the band member for releasably connecting the first end to the fabric clamp. Preferably, the fabric securing device further includes an additional clip member and the second end of the band member is releasably connected to the fabric clamp by the additional clip member.

The present invention will be understood and appreciated more fully from the following detailed description, taken in conjunction with the accompanying drawings.

DETAILED DESCRIPTION OF PREFERRED EMBODIMENTS

Figure 1:
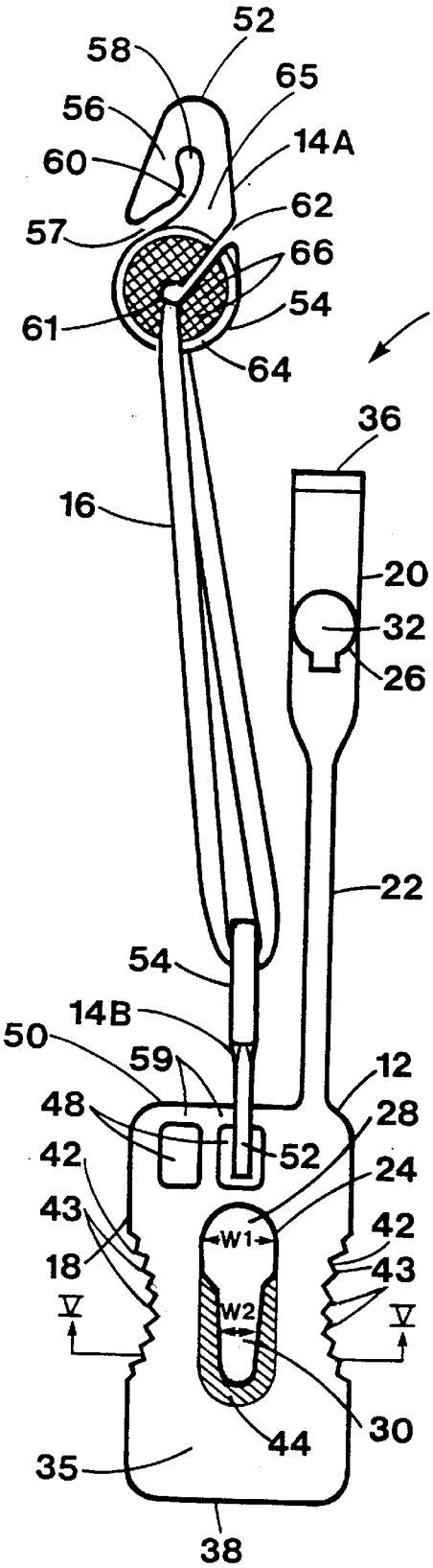
FIG. 1 is a front view of a preferred embodiment of a fabric securing device in accordance with the present invention.
Figure 2:
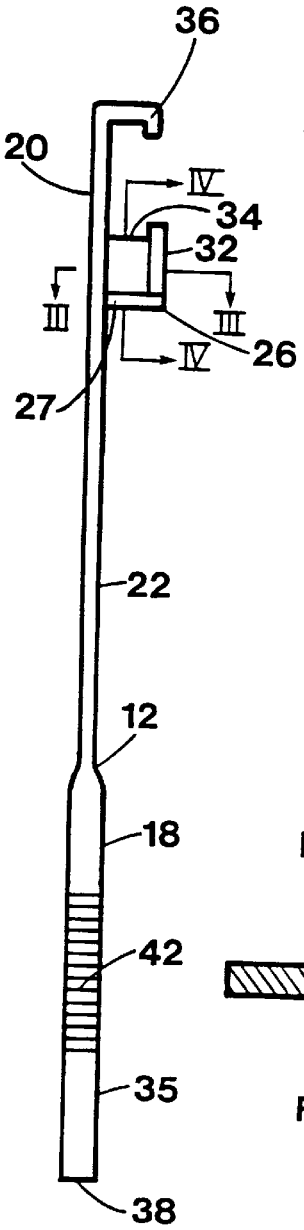
FIG. 2 is a left side view of a fabric clamp of the fabric securing device of FIG. 1.

FIG. 1 shows a preferred embodiment of a fabric securing device 10 in accordance with the present invention. The fabric securing device 10 includes a fabric clamp 12, two clip members 14A and 14B, and an elongate elastomeric band member 16.

Figure 3:
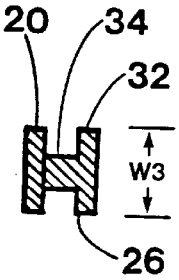
FIG. 3 is a cross-sectional view of a clamping member of the fabric clamp of FIG. 2 taken along the line III—III of FIG. 2.
Figure 4:
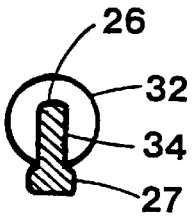
FIG. 4 is a cross-sectional view of a stud of the clamping member taken along the line IV—IV of FIG. 2.
Figure 5:
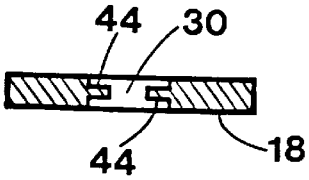
FIG. 5 is a cross-sectional view of the fabric clamp taken along the line V—V of FIG. 1.

Referring to FIGS. 1 through 5, the fabric clamp 12 has a main clamp body 18 and a clamping member 20 between which a fabric article such as a beach towel can be engaged. In the preferred embodiment, the main clamp body 18 of the fabric clamp 12 is substantially a flat plate with a generally rectangular shape. A substantially key-hole shaped hole 24 is provided through the main clamp body 18. The key-hole shaped hole 24 has a first hole portion 28 with a first transverse width W1, and an elongate second hole portion 30 with a second transverse width W2. The first transverse width W1 of the first hole portion 28 is larger than the second transverse width W2 of the second hole portion 30. Preferably, the transverse width of the second hole portion 30 decreases as the distance from the point at which the second hole portion 30 meets the large hole portion 28 increases. The second hole portion 30 is preferably surrounded by a lip 44, which, as shown in FIG. 5, is not as thick as the rest of the main clamp body 18.

The clamping member 20 is an elongate substantially planar member with an outwardly extending stud 26. The stud 26 includes a shank portion 34 with an enlarged head 32. Referring to FIG. 3, which shows a transverse cross-section of the stud 26 taken along the line III—III of FIG. 2, the enlarged head 32 has a width W3 which is smaller than the width W1 of the first hole portion 28 of the main clamp body 18, which enables the head 32 to be inserted through the first hole portion 28. The width W3 of the head 32 is larger than the width W2 of the second hole portion 30. The transverse width of the shank 34 is narrower than the width W2 of the second hole portion 30 so that the shank 34 can be slidably received within the second hole portion 30 once the head 32 of the stud 26 has been inserted through the first hole portion 28 in the main clamp body 18. Referring to FIG. 4, which shows a cross-section of the stud 26, the shank 34 has an elongate cross-section, which increases the strength of the stud 26. A small rib 27 is preferably formed on each side of the stud 26 near one end thereof.

In the preferred embodiment of the invention, the main clamp body 18 is connected to the clamping member 20 by an elongate flexible connecting member 22 so that the main clamp body 18 and the clamping member 20 will not become separated from each other. The fabric clamp 12 is preferably injected moulded from a resilient plastic material such that the main clamp body 18, the clamping member 20, and the connecting member 22 are all integrally connected together as a unitary piece of plastic.

Referring again to FIG. 1, the fabric clamp 12 includes two receptacles or apertures 48 formed through its main clamp body 18. The apertures 48 are located near an upper peripheral edge 50 of the fabric clamp 12 and are configured to cooperate with the clips 14A and 14B so that the fabric clamp 12 can be secured to a structure or piece of furniture such as a beach chair by the clips 14A and 14B and the band member 16. A support bar 59 is formed between the apertures 48 and the upper peripheral edge 50 of the main clamp body 18. The front 35 and rear (not shown) surfaces of the main clamp body 18 are preferably large enough that space is provided for written advertisements, trademarks, slogans, instructions, and/or other information to be displayed on the fabric clamp 12.

The clips 14A and 14B, which are preferably identical, each have a first clip portion 52 for attaching the clip to the fabric clamp 12, and a second clip portion 54 for attaching the clips 14A and 14B to the band 16, and are preferably formed from a resilient plastic material. In order to attach the clips 14A and 14B to the fabric clamp 12, the first clip portion 52 includes an extending hook member 56, which is dimensioned so that it can be slidably received within one of the apertures 48 in the fabric clamp 12. An elongate slot 57 is formed between the extending hook member 56 and the rest of the first clip portion 52 for slidably receiving the support bar 59 when the hook member 56 is inserted through one of the apertures 48. The slot 57 preferably has an enlarged portion 58 at its apex and a narrower throat portion 60. The enlarged portion 58 is large enough that the clip 14A or 14B can be freely rotated in an arc about the support bar 59 when the support bar 59 is received within the enlarged portion 58 of the clip. The throat portion 60 is narrower than the width of the support bar 59 such that the resilient clips 14A and 14B must be temporarily deformed in order to attach them to or remove them from the fabric clamp 12. In other words, the clips 14A and 14B must be "snapped" onto the main clamp body 18. Thus, a certain amount of force must be used to attach or remove the clips 14A and 14B to or from the main clamp body 18, which helps to avoid the inadvertent removal of a clips 14A and 14B from the fabric clamp 12. In FIG. 1, the clip 14B is attached to the main clamp body 18 of the fabric clamp 12.

A hole 61 is formed through the second portion 54 of each of the clips 14A and 14B so that the band 16 can be attached to each of the clips 14. Each clip 14A, 14B may include a slot 62 in its second portion 54 communicating between the peripheral edge of the clip 14 and the hole 61 so that the band 16 can be attached to the clip 14A and 14B, respectively, by sliding a portion of one side of the band through the slot 62 and into the hole 61. Preferably, the band 16 is thick enough and the slot 62 narrow enough than either the band 16 and/or the clips 14A and 14B must be temporarily deformed to attach or remove the band 16 from the clips 14A and 14B, which can help prevent accidental removal of the band from the clips.

The clips 14A and 14B are generally planar along their front and rear surfaces, however in order to make the clips 14A and 14B easier to grip, a raised ridge 64 can be provided along the peripheral edge of the second portion 54 of the clips 14A and 14B. Additionally, all or a portion of the front and rear surfaces of the clips 14A and 14B may include a number of ridges, bumps, or other grip-enhancing features in order to provide a surface that can be gripped by fingers covered in suntan oil, water or other lubricants. By way of example, a number of cross-hatched ridges 66 are provided on portions of the front 65 and rear (not shown) surface of the clip 14A shown in FIG. 1.

The elongate band 16 may be a conventional continuous elastic band, or it may be an elastic band made from other types of materials, such as pure gum rubber with additives, synthetic rubber such as EPDM, or silica compounds. Preferably, the elongate band 16 is made from material that is durable and resistant to breakdown by UV rays from the sun. Because of the construction of the clips 14A and 14B, if and when the elongate band 16 does break or wear out, the broken or worn out band can easily and quickly be replaced with a new band. It will be understood that the elongate band 16 does not have to be a continuous band, but rather could be a straight band with loops formed at both ends. The band 16 could also simply be a straight band, the ends of which could be tied to the clips 14A and 14B. Preferably, the surface of the elastic band 16 has a relatively high coefficient of friction so that the band 16 will generally not slip or shift when it is attached to a structure.

Figure 6:
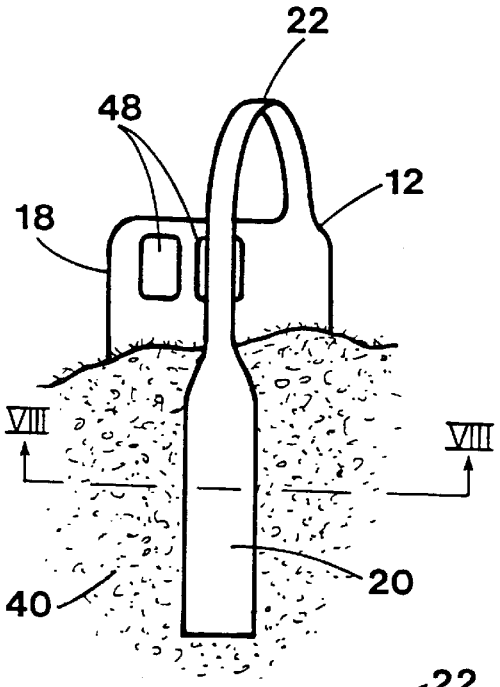
FIG. 6 is front view of the fabric clamp engaging a fabric article.
Figure 8:
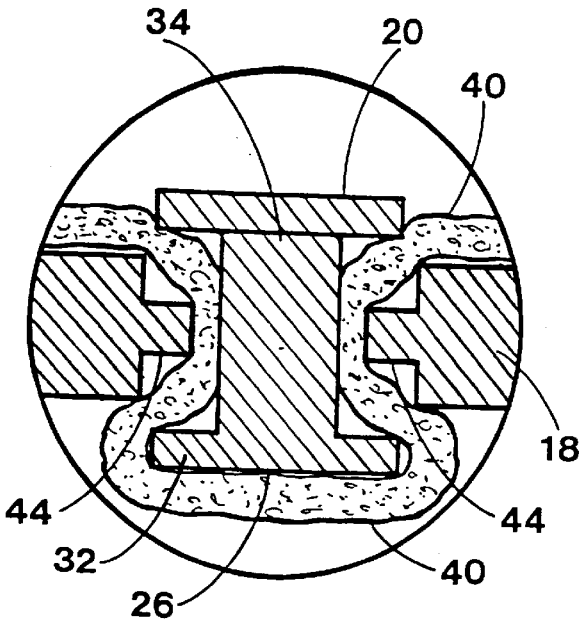
FIG. 8 is a partial cross-sectional view of the fabric clamp and fabric article taken along the line VIII—VIII of FIG. 6.
Figure 7:
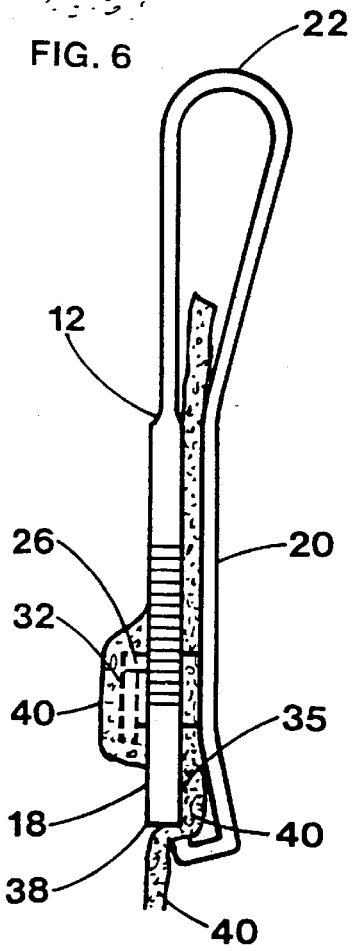
FIG. 7 is a left side view of the fabric clamp and fabric article of FIG. 6.

The fabric clamp 12 engages a fabric article in a manner similar to the manner in which a conventional garter clasp engages a fabric article. With reference to FIGS. 6 to 8, a fabric article 40 is secured to the fabric clamp 12 by first placing a portion of the fabric article 40 over the front surface 35 of the main clamp body 18. The clamping member 20 is then rotated about the main clamp body 18 and positioned over the fabric article 40 and the main clamp body 18 so that the head 32 of the stud 26 is lined up with the first hole portion 28 in the main clamp body 18. The head 32 is then pushed through the first hole portion 28, together with a portion of the fabric article 40. The stud 26 is then slid into the second hole portion 30 such that the shank 34, and the portion of the fabric article 40 which was pushed into the hole 24 by the stud 26, are slidably received within the second hole portion 30. A portion of the fabric article 40 covering the stud 26 is engaged between the stud 26 and the edges of the lip 44 which surround the second hole portion 30 (FIG. 8). The gripping forces applied to the portion of the fabric article 40 by the stud 26 and the edges of the lip 44 are generally sufficient enough to prevent removal of the article 40 from the fabric clamp 12 until the stud 26 is slid back into the first hole portion 28 and disengaged from the main clamp body 18.

The reduced thickness of the lip 44 relative to the thickness of the rest of the main clamp body 18 provides the lip 44 with greater flexibility than the rest of the main clamp body 18, which allows the fabric clamp 12 to adjust for fabric articles of different weights and textures. Preferably, the width of the shank 34 of the stud 26 and the transverse width W2 of the second hole portion 30 are such that the fabric clamp 12 can securely engage a wide variety of fabrics of different thicknesses and textures. In one preferred embodiment, the transverse width W2 of the second hole portion 30 is approximately 7/16th inches (10 mm) at its widest point and 5/16th inches (8 mm) at its narrowest point, and the transverse width of the shank 34 is approximately 3/16th inches (5 mm). The small ribs 27 on the stud 26 further enhances the gripping power of the fabric clamp 12.

In order to allow the main clamp body 18 of the fabric clamp 12 to be easily gripped, a generally concave depression 42 is conveniently provided along each of the two opposing peripheral edges of the main clamp body 18 that run parallel to the elongate axis of the key-hole shaped hole 24 (FIG. 1). The concave depressions 42 can include a plurality of grip-enhancing ribs 43 to allow a person to get a better grip on the main clamp body 18. These grip enhancing features of the main clamp body 18 are particularly helpful in situations where the person's hands may be slippery with substances such as suntan oil.

Figure 9:
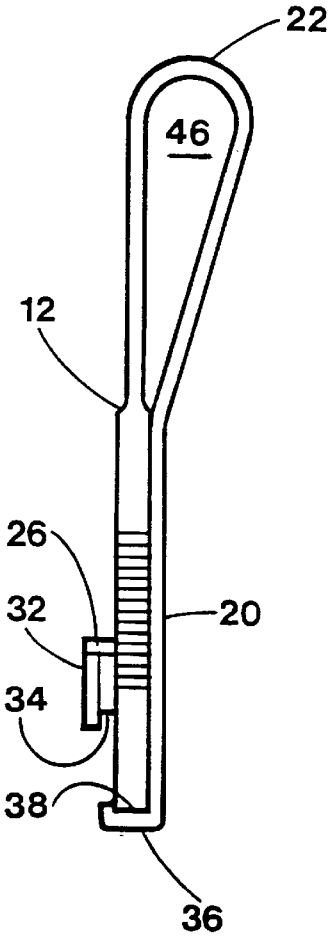
FIG. 9 is a further left side view of the fabric clamp.

Referring to FIG. 9, the clamping member 20 can be secured to the main clamp body 18 when the fabric clamp 12 is not in use by inserting the head 32 of the stud 26 through the first hole portion 28 and then sliding the stud 26 into the second hole portion 30 of the main clamp body 18 such that the shank 34 of the stud 26 extends through the second hole portion 30. A loop 46 is formed by the connecting member 22 when the clamping member 20 is secured to the main clamp body 18, which is convenient for storing and transporting a plurality of the devices 10 as the loops 46 of the devices can be interlinked with one another. In one preferred embodiment, a hook portion 36 is provided on the top end of the clamping member 20 for engaging a bottom peripheral edge 38 of the main clamp body 18 when the clamping member 20 is secured directly (in the absence of a fabric article) to the main clamp body 18, thus ensuring that the clamping member 20 will not become inadvertently detached from the main clamp body 18. The resilient nature of the connecting member 22 also helps to secure the clamping member 20 to the main clamp body 18 as it urges the clamping member 20 away from the main clamp body 18 so that the head 32 of the stud engages the rear surface of the main clamp body 18.

In operation, the fabric securing device 10 of the present invention can be used to secure a fabric article to a structure by engaging the fabric article between the main clamp body 18 and the clamping member 20 of the fabric clamp 12 in the manner described above, and then looping the band 16 around a part of the structure (such as a chair leg) and attaching both of the clips 14A and 14B to the main clamp body 18. The fabric securing device can be subsequently be released from the structure by detaching one or both of the clips 14A and 14B from the main clamp body 18.

When a fabric securing device 10 is used to secure a fabric article to a structure, it will preferably be attached between the article and the structure so that the elastic band 16 will be in a stretched state. When the elastic band 16 is stretched, the elastic band 16 will apply a force in one direction on the main clamp body 18, and the fabric article engaged by the fabric clamp 12 will apply an opposite force on the main clamp body 18. These opposite forces help to further secure the grip the fabric clamp 12 has on the fabric article as they will generally urge the stud 26 of the clamping member 20 further into the narrow hole portion 30 of the main clamp body 18 and away from the larger hole portion 28.

Figure 10:
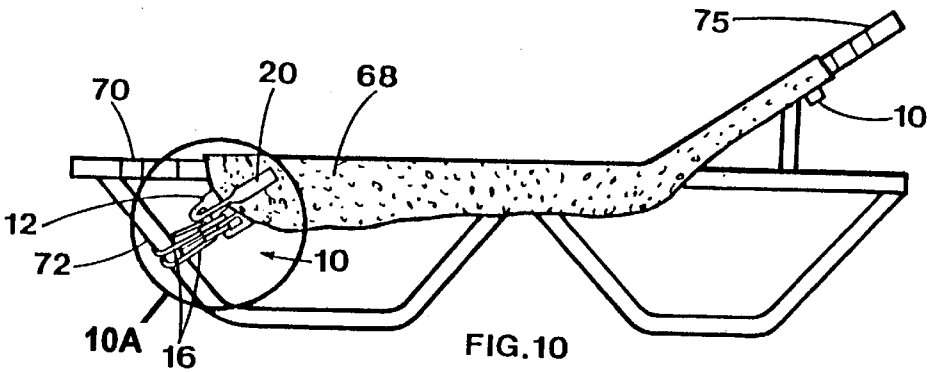
FIG. 10 illustrates a plurality of the fabric securing devices of the present invention securing a beach towel to a beach chair.
Figure 10A:
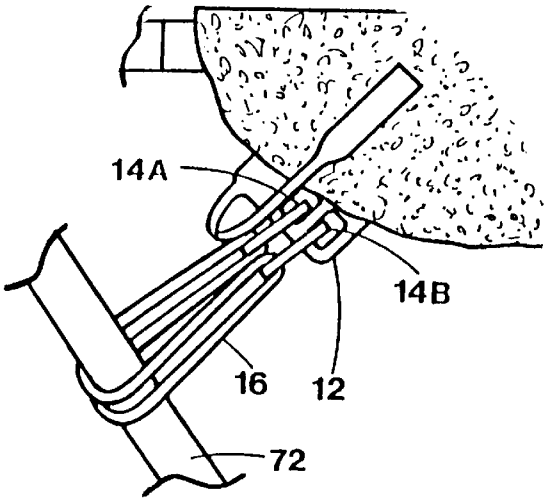
FIG. 10A is an enlarged view of a portion of FIG. 10.
Figure 11A:
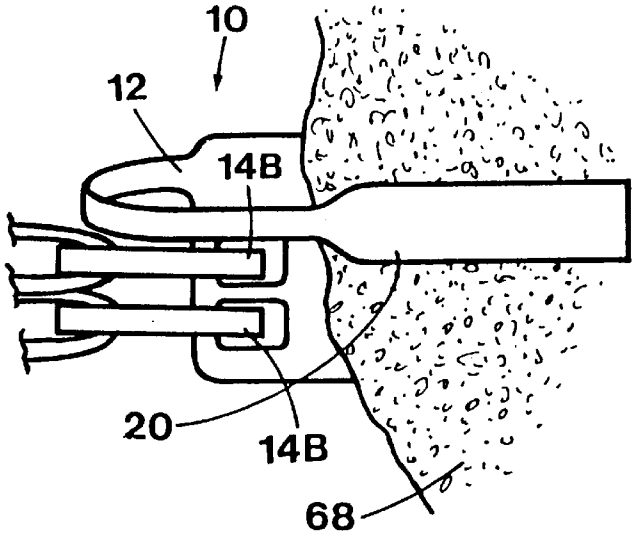
FIG. 11A is an enlarged view of a portion of FIG. 11.
Figure 11:
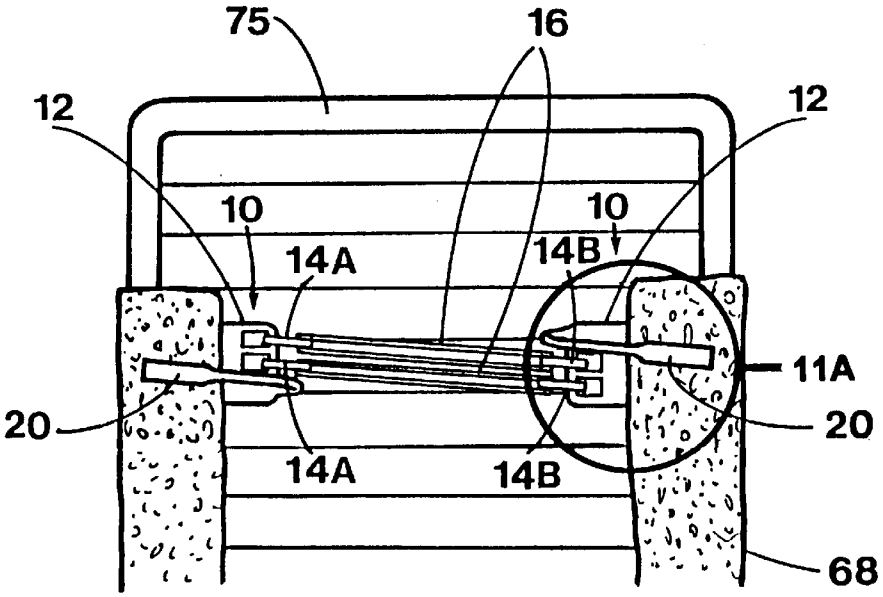
FIG. 11 is a partial back view of the beach chair, beach towel and fabric securing devices of FIG. 10.

FIGS. 10 and 11 illustrate one exemplary manner in which a plurality of the fabric securing devices 10 of the present invention can be used to secure a beach towel 68 to a beach chair 70. In order to secure one side of the bottom portion of the towel 68, a fabric clamp 12 of one fabric securing device 10 is secured to a portion of the towel 68 near the foot rest of the chair 70, as shown in FIG. 10 (enlarged view FIG. 10A). The elastic band 16 of the securing device 10 is wrapped around a portion of the frame 72 of the chair 70, and secured to the fabric clamp 12 by the clips 14A and 14B. Preferably, the elastic band 16 of the fabric securing device 10 shown in FIG. 10 is in a stretched state so that tension is placed on the corner of the towel 68. The lower portion of the other side of the beach towel 68 is similarly secured to the other side of the beach chair 70 (not shown) by a further fabric securing device 10.

The upper portion of the towel 68 is secured to the head rest 75 of the chair 70 as shown in FIG. 11 (which is a back view of the head rest 75). The sides of the towel 68 are wrapped around the edges of the chair, and as shown in FIG. 11 (enlarged view FIG. 11A), secured to each other by two interconnected fabric securing devices 10. Specifically, the fabric clamps 12 of the two devices 10 are each secured to opposite sides of the towel 68 and each band 16 is connected to each of the fabric clamps 12 by its clips 14A and 14B.

Figure 12:
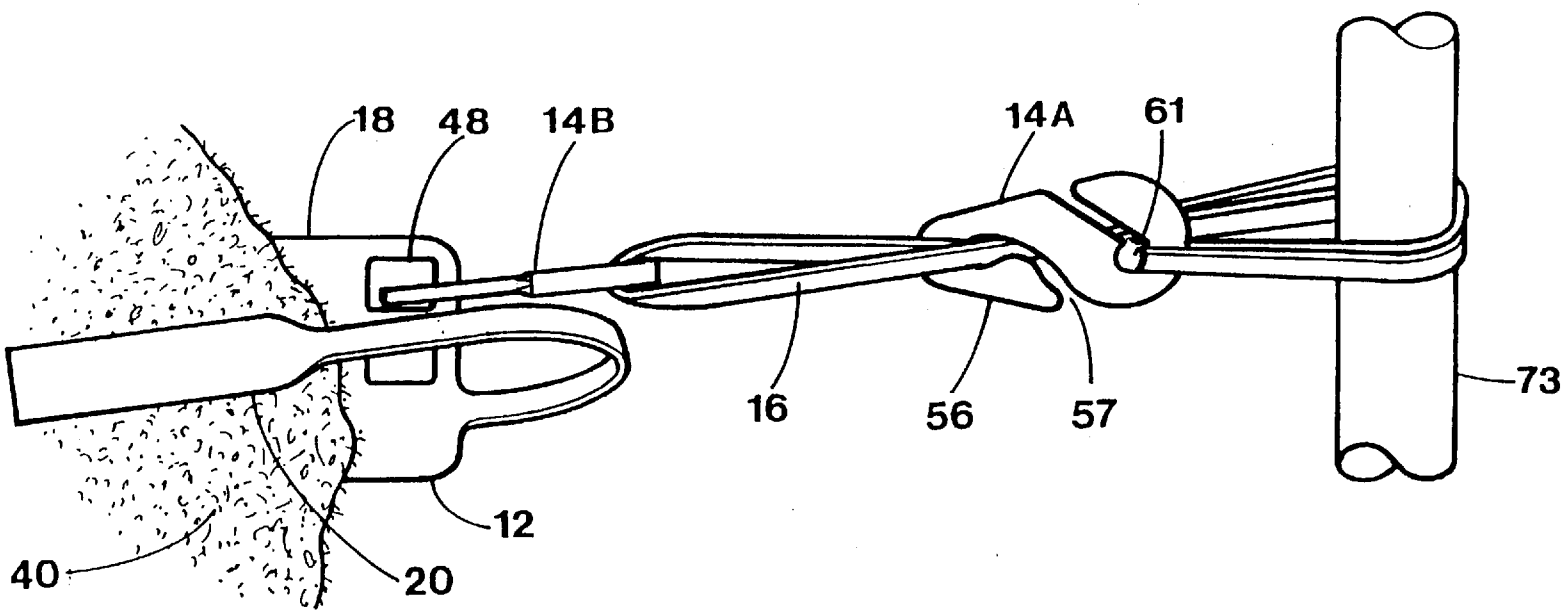
FIG. 12 illustrates a securing device of the preset invention securing a portion of a beach towel to a chair leg.

It will be understood that the elastic nature of the band 16 and the design of the fabric clamp 18 and the clips 14 provide a fabric securing device that can be used to secure a fabric article such as a towel to a structure such as a chair in a variety of ways other than as shown in FIGS. 10 and 11. For example, with reference to FIG. 12, one clip 14B could be connected to the main clamp body 18 of the fabric clamp 12, the band 16 could be wrapped around a part of a structure 73, and the hook portion 56 of the other clip 14A could simply be hooked over part of the band 16 that extended between the main clamp body 18 and the structure 73. Alternatively, the band 16 could also be attached to the structure 73 by wrapping the band 16 around the structure 73 and then threading the clip 14A through the middle of the band 16 and attaching that same clip 14A to the main clamp body 18 of the fabric clamp 12. In such an application, the other clip 14B would not serve any functional purpose.

It will be appreciated by those skilled in the art that one or more of the fabric securing devices 10 can be used in a wide variety of ways to secure beach towels of varying thicknesses and textures to a wide variety of different types of chairs and other structures. If the band 16 is longer than required in a particular application, it can be wrapped around a portion of a structure a number of times to reduce any slack that may occur in the band 16.

Figure 14:
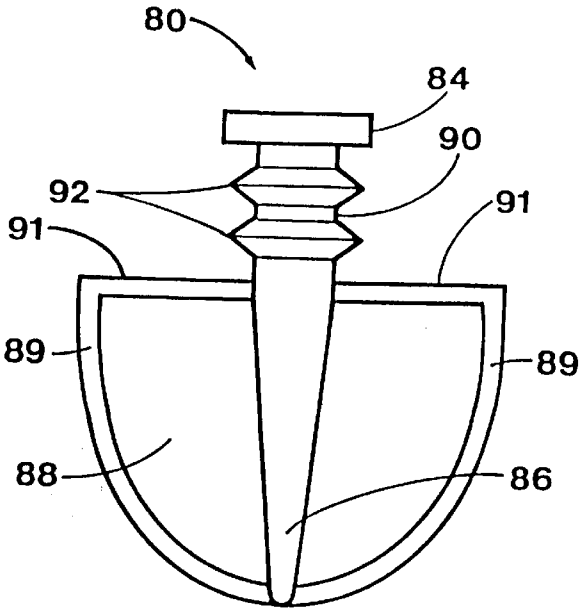
FIG. 14 is a front view of the stake of FIG. 13.
Figure 13:
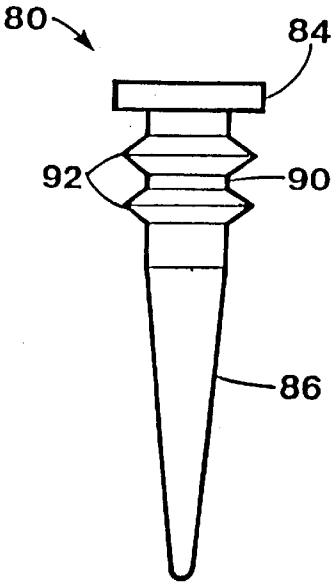
FIG. 13 is a right side view of a stake in accordance with the present invention.

In some situations, it may be necessary to secure a beach towel to a surface, such as a sand or gravel, where there is no suitable structure close by to attach a fabric securing device 10 to. In such situations, anchoring means such as stakes or pegs can be driven into the ground and used in combination with fabric securing devices 10 to secure the towel to the surface. Although conventional tent pegs or stakes may be used in combination with the fabric securing devices 10, such pegs or stakes may not provide satisfactory holding characteristics in sandy areas or loose soil. In order to overcome this problem, a further aspect of the present invention is a novel anchoring stake for use in combination with the fabric securing devices 10 in areas where the surface is sandy or otherwise not firm. FIG. 13 shows a side view of a preferred embodiment of a stake 80 for use in combination with the fabric securing device 10 and FIG. 14 shows a front view of the stake 80. The stake 80 includes an elongate shaft 86 with a head portion 84 located at an upper end of the shaft 86. A pair of generally planar wings 88 extend from opposite sides of the shaft 86. A strengthening rib 89 is provided around the outer peripheral edges of the wings 88. A neck portion 90 is provided between the head 84 and an upper edge 91 of the wings 88 for attaching the elastic band 16 of a fabric securing device 10 to the stake 80. Preferably, a number of annular ridges 92 are provided on the neck 90 of the stake 80 for engaging an elastic band 16 which is wrapped around the neck 90 during use of the stake 80.

Figure 15A:
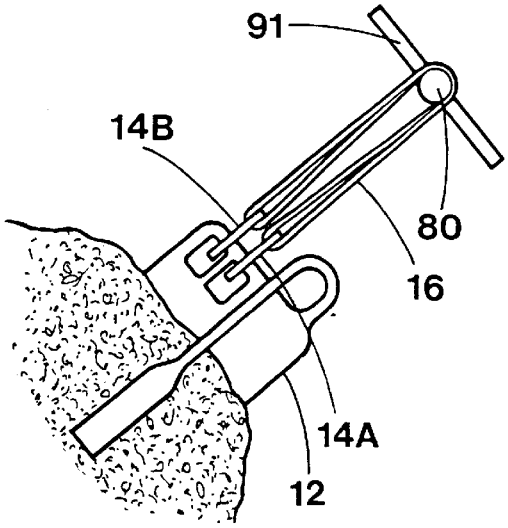
FIG. 15A is an enlarged view of a portion of FIG. 15.
Figure 15:
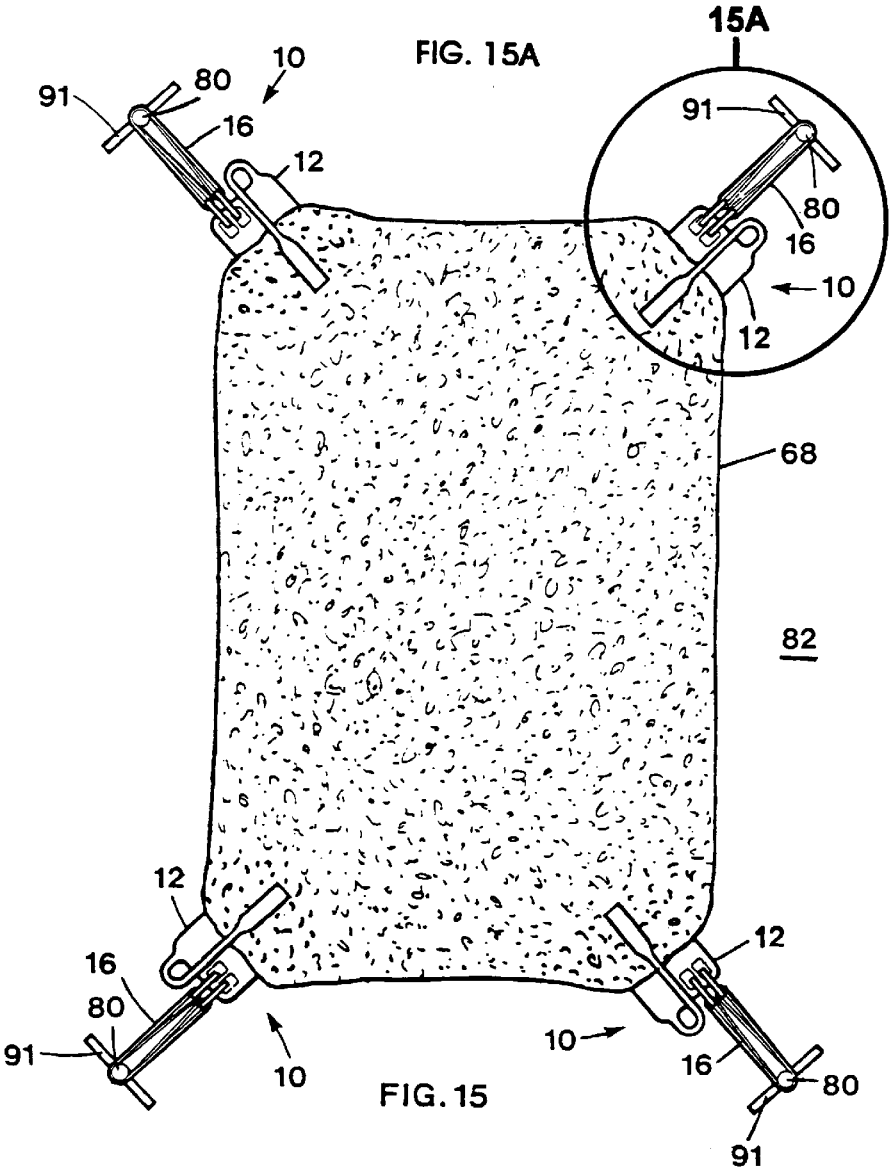
FIG. 15 is a plan view of a beach towel secured to a sandy beach by a plurality of fabric securing devices and stakes.

FIG. 15 shows a top view of a beach towel 68 secured to a sandy beach surface 82 by four fabric securing devices 10 used in combination with four anchoring stakes 80. The elastic bands 16 of the fabric securing devices 10 are each wrapped around the necks of one of the stakes 80 and secured to their respective fabric clamps 12, which in turn are each secured to a corner of the towel 68. The stakes 80 have each been inserted into the sandy beach such that the shaft 86 and wings 88 of each of the stakes are substantially inserted into the sandy ground, and the planar surface of the wings 88 are generally perpendicular to the corners of the towel 68. The wings 88 provide the stakes 80 with a greater sand engaging surface area, which helps to prevent the stakes 80 from being pulled out of the ground by any horizontal forces which are applied to the stakes 80 by the elastic bands 16. The stakes 80 could be inserted at an angle with their heads 84 tilted away from the towel 68 to further increase the strength with which it resists movement of the towel 68. The stake 80 may be formed from rigid plastic, or from other materials of sufficient strength and durability.

In addition to the stakes 80, the fabric securing devices 10 of the present invention can also be used in conjunction with other types of movable anchoring devices. For example, the elastic bands 16 can each be connected to a small weight, or to small bag or rigid container that may be fillable with sand, water, rocks, earth or other materials. Additionally, the fabric securing devices 10 can each be used in conjunction with an anchoring device which includes a suction cup so that a beach towel can be secured to a smooth surface such as a fibreglass boat deck.

From the above description of the fabric securing device 10 and examples of its use, it will be appreciated that the fabric securing device 10 of the present invention can be used to secure fabric articles other than beach towels. To name a few, fabric securing devices 10 can be used to secure bed sheets to beds, table clothes to tables and bathing suits to clotheslines and other structures.

As described herein, the main clamp body 18 of the present invention includes two apertures 48 for attaching the clips 14A and 14B to the main clamp body 18. It is possible that both of the clips 14A and 14B could be attached to the fabric clamp 12 even if the main clamp body 18 only had one aperture 48 formed therethrough. However, the inclusion of two apertures 48 keeps the clips 14A and 14B separated when they are attached to the main clamp body 18, making them easier to grip individually.

In some circumstances, it may not be necessary that the fabric securing device of the present invention include both clips 14A and 14B. For example, one end of the band 16 could be attached directly to the main clamp body 18 by securing it to the support bar 59 of the main clamp body 18 directly, rather than securing the band to the clip 14B and then securing the clip 14B to the main clamp body 18. The other end of the band would still have the clip 14A secured to it so that it could be releasably connected to the main clamp body 18 by the clip 14A.

Figure 16:
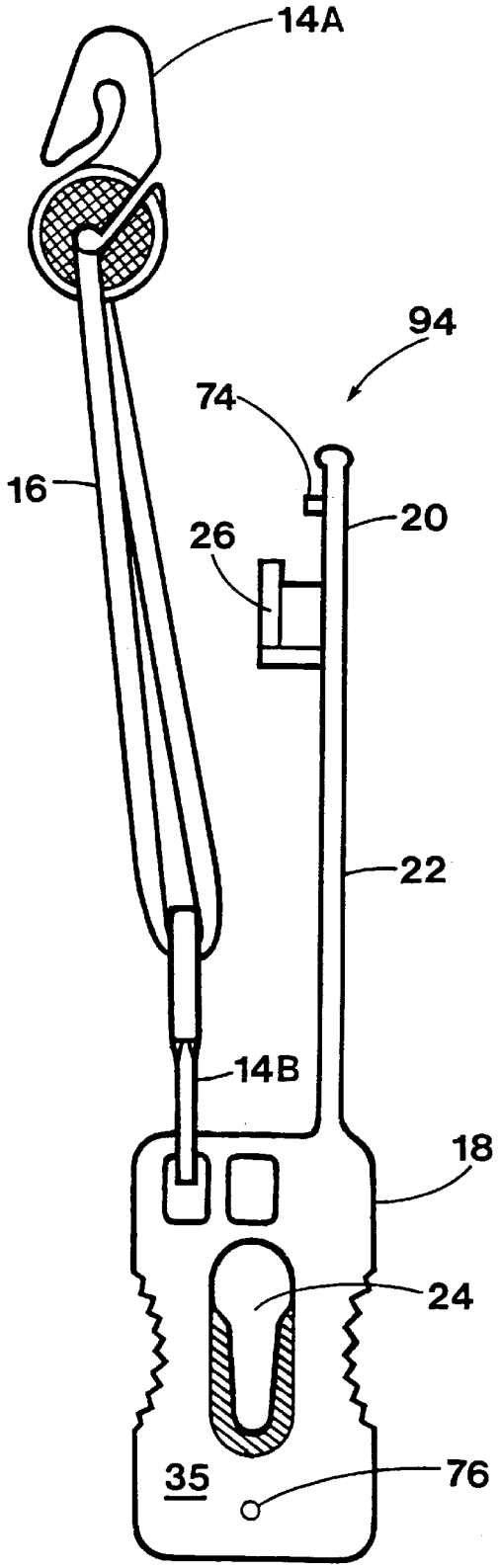
FIG. 16 is a front view of a fabric clamp of a further preferred embodiment of the fabric securing device of the present invention.
Figure 17:
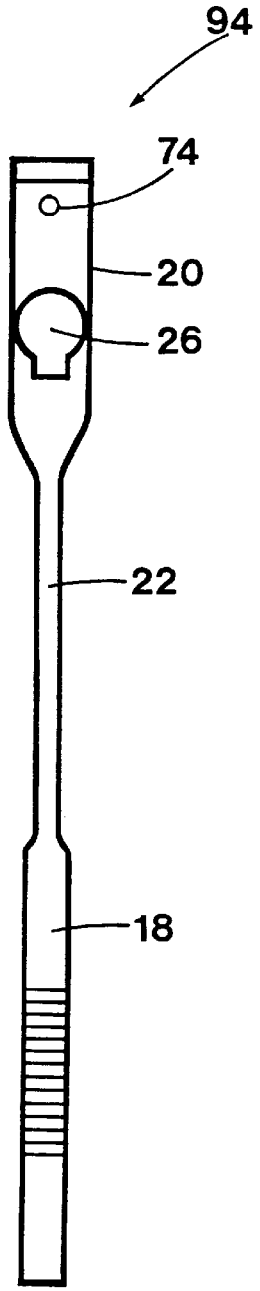
FIG. 17 is a side view of the fabric clamp of FIG. 16.

As mentioned above, the fabric clamp of the fabric securing device 10 is preferably injection moulded as a unitary piece of resilient plastic. In a further preferred embodiment of the fabric securing device, a fabric clamp 94 (shown in FIGS. 16 and 17) is used in place of the fabric clamp 12 described above. The fabric clamp 94 is substantially similar to the fabric clamp 12 described above and illustrated in drawings 1 to 9, except as hereinafter described. The clamping member 20 of the fabric clamp 94 is attached to the connecting member 22 in such a manner that the planar surface of the clamping member 20 is biased in a position orthogonal to the planar surface 35 of the main clamp body 18 when the fabric clamp is in an unclamped state, as shown in FIGS. 16 and 17. In use, the clamping member 20 of the fabric clamp 94 must be rotated 90 degrees about the elongate axis of the connecting member 22 (and then rotated about the main clamp body 18) before it can be clamped to the main clamp body 18. This design is advantageous as it reduces the cost of the mould required to injection mould the fabric clamp 94 and it allows the clamping member 20 to be connected to the front or back of the main clamp body 18 with equal ease.

In the embodiment of the fabric clamp 12 described above, a hook portion 36 is provided on the top of the clamping member 20 of the fabric clamp 12 for engaging the bottom edge 38 of the main clamp body 18 to help the clamping member 20 stay secured to the main clamp body 18 when the fabric clamp 12 is not in use. It will be appreciated that the hook portion 36 could be replaced with other securing means. For example, the fabric clamp 94 of FIGS. 16 and 17 does not include a hook portion 36, but instead includes a protruding male connector 74 for cooperating with a corresponding female receptacle 76 that is provided through the front surface 35 of the main clamp body 18. When the clamping member 20 is attached to the main clamp body 18 (when the fabric clamp 94 is not in use) by inserting the stud 26 into the key-hole shaped hole 24, the male connector 74 can be inserted into the female receptacle 76, and the friction between the connector 74 and the walls of the receptacle 76 help keep the clamping member 20 and the main clamp body 18 secured together.

Figure 18:
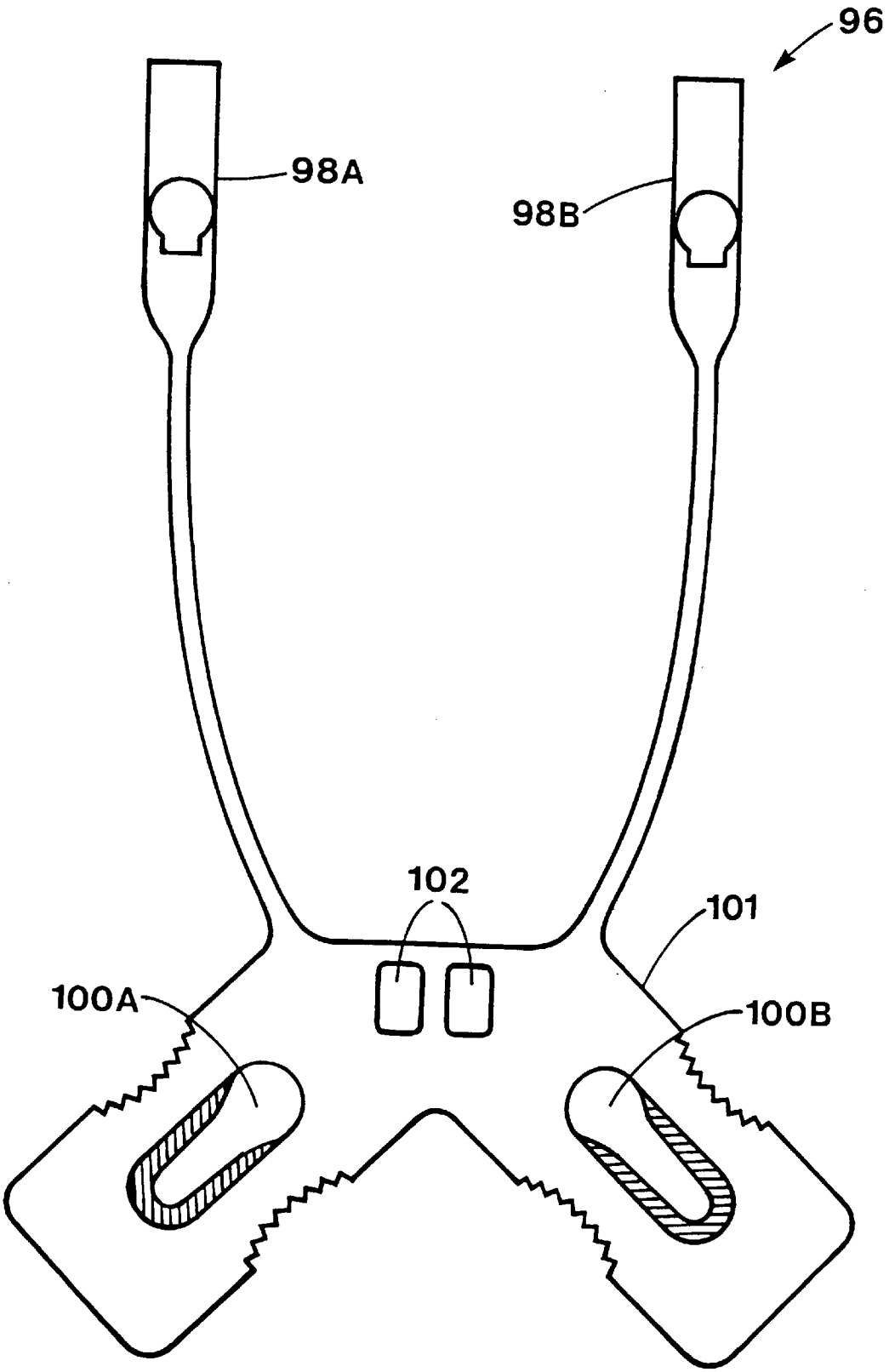
FIG. 18 is a front view of a fabric clamp of a further preferred embodiment of the fabric securing device of the present invention.

Although in the preferred embodiments of the invention described above the fabric clamp 12 engages a fabric article in the same manner in which a conventional garter clasp engages fabric articles, it will be appreciated that different types of fabric clamps employing different fabric securing means could be used with the fabric securing device of the present invention. Additionally, the fabric clamp described above could be modified to include more than one fabric engaging portion. For example, FIG. 18 illustrates a fabric clamp 96 in accordance with a further preferred embodiment of the fabric securing device of the present invention. The fabric clamp 96 is similar to the fabric clamp 12 described above, except that the fabric clamp 96 includes two clamping members 98A and 98B and two corresponding key-hole shaped receptacles 100A and 100B formed in a main clamp body 101. Two apertures 102 are formed through the main clamp body 101 to permit the clips 14A and 14B and elastic band 16 to be connected to the fabric clamp 96. The receptacles 100A and 100B are generally oriented so that they form a V shape pattern in the main clamp body 101, which makes the fabric clamp 96 useful for simultaneously clamping two different edges of a fabric article that have been draped over a piece of furniture, or two different fabric articles simultaneously, or one edge of one fabric article very securely.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A fabric securing device for securing a fabric article, the fabric securing device comprising:

a fabric clamp for releasably engaging a fabric article;

a flexible band;

a first clip member connected to a first portion of said band and adapted to be releasably connected to said fabric clamp; and a second clip member connected to a second portion of said band and adapted to be releasably connected to said fabric clamp.

2. A fabric securing device according to claim 1 wherein two apertures are formed through said fabric clamp and each of said clip members include a hook portion that can be inserted into one of said apertures for releasably connecting the respective clip member to said fabric clamp.

3. A fabric securing device according to claim 2 wherein said fabric clamp comprises a main clamp body and a clamping member for releasably securing a fabric article to said main body, said main clamp body being generally planar, said two apertures being located in said main clamp body.

4. A fabric securing device according to claim 3 wherein said main clamp body has an elongate hole formed therethrough, said hole having a first hole portion communicating with a second hole portion, the width of said first hole portion being larger than the width of said second hole portion, and said clamping member comprises a stud with an enlarged head, the dimension of said enlarged head and said stud being such that said clamping member can be secured to said main clamp body by inserting said stud into said first hole portion and moving said stud from said first hole portion to said second hole portion.

5. A fabric securing device according to claim 4 wherein said main clamp body and said clamping member are connected together by a flexible connecting member and said main clamp body, said clamping member and said connecting member are formed from a unitary piece of resilient material.

6. A fabric securing device according to claim 4 wherein said main clamp body includes a lip around said second hole portion, said lip having a thickness less than the rest of said main clamp body.

7. A fabric securing device according to claim 4 wherein the width of said second hole portion decreases as the distance from said first hole portion increases.

8. A fabric securing device according to claim 3 wherein a concave depression is formed at each of two opposing portions of a peripheral edge of said main clamp body.

9. A fabric securing device according to claim 3 wherein said clamping member includes a hook portion for engaging said peripheral edge of said main clamp body.

10. A fabric securing device according to claim 3 wherein said clamping member includes a male connector and a female receptacle is provided in said main clamp body for cooperating with said male connector.

11. A fabric securing device according to claim 3 wherein said fabric clamp includes a further clamping member for releasably securing a fabric article to said main clamp body.

12. A fabric securing device according to claim 2 wherein said clip members each have a hole formed therethrough and slot formed therein communicating between said hole and a peripheral edge of the clip member for permitting said band to be connected to each clip member.

13. A fabric securing device according to claim 12 wherein said clip members each include grip enhancing formations thereon.

14. A fabric securing device according to claim 2 wherein said clip members are formed from a resilient material and are dimensioned so that said clip members must be temporarily deformed to insert their respective hook portions into said apertures.

15. A fabric securing device according to claim 1 wherein said flexible band is made from elastomeric material.

16. A fabric securing device according to claim 1 further including an anchor for securing a portion of said flexible band to a surface.

17. A fabric securing device according to claim 16 wherein said anchor comprises a stake having a central shaft and two planar wings extending in substantially opposite directions from said central shaft.

18. A fabric securing device according to claim 1 wherein an aperture is formed through said fabric clamp and each of said clip members includes a hook portion that can be inserted into said aperture for releasably connecting the respective clip member to said fabric clamp.

* * * * *